United States Patent [19]

Abe et al.

[11] Patent Number: 4,543,149

[45] Date of Patent: Sep. 24, 1985

[54] STRIP SUPPLYING APPARATUS

[75] Inventors: Norio Abe, Higashimurayama; Yoshiaki Kawahara, Kodaira, both of Japan

[73] Assignee: Bridgestone Corporation, Tokyo, Japan

[21] Appl. No.: 659,549

[22] Filed: Oct. 10, 1984

[30] Foreign Application Priority Data

Dec. 27, 1983 [JP] Japan ..... 58-248945

[51] Int. Cl.[4] ..... B65H 19/08

[52] U.S. Cl. ..... 156/350; 156/504; 242/58.1; 242/58.2; 242/58.6

[58] Field of Search ..... 156/502, 504, 505, 157, 156/361, 310; 242/58.1-58.6

[56] References Cited

U.S. PATENT DOCUMENTS 4,392,912 7/1983 Horsley ..... 156/504

4,441,662 4/1984 Seragnoli ..... 242/58.6

*Primary Examiner*—David Simmons

*Attorney, Agent, or Firm*—Cushman, Darby & Cushman

[57] ABSTRACT

A strip supplying apparatus comprising a stationary frame structure, a movable frame structure movable with respect to the stationary frame structure along the side wall of the stationary frame structure and having a plurality of winding reels rotatable on the movable frame structure about an axis of rotation substantially in parallel with a direction in which the movable frame structure are moved with respect to the stationary frame structure, the winding reels being spaced in an equal pitch to each other, drive unit mounted on the stationary and movable frame structures for driving the movable frame structure to move with respect to the stationary frame structure by the pitch; unwinding unit mounted on the stationary frame for unwinding a strip unwound from each of the winding reels, joining unit mounted on the stationary frame structure for joining the trailing and leading end portions of the strips unwound from two adjacent winding reels, the unwinding and joining unit being held in line with one of the winding reels, detecting unit for detecting the trailing end portion of the strip unwound from the winding reel to produce a signal to drive the movable frame structure to move with respect to the stationary frame structure by the pitch; and tension adjusting unit for adjusting tension of the strip fed from the unwinding unit.

8 Claims, 2 Drawing Figures

STRIP SUPPLYING APPARATUS

FIELD OF THE INVENTION

The present invention relates to a strip supplying apparatus, and in particular to a strip supplying apparatus for continuously supplying strips, unwound from a plurality of winding reels, to a wrapping apparatus in a following process.

BACKGROUND OF THE INVENTION

In general, a pneumatic tire has a pair of bead wires embedded in the bead portions thereof and each consisting of a number of turns of wires in the form of a ring shape which is usually kept by a strip helically wrapped around the bead wire. Conventionally, a limited length of strip by a winding winding reel is wound before being wrapped around the bead wire. Therefore, an empty winding reel is required to be changed for a full winding reel when the limited length of the strip has been unwound from the winding reel before the strip is completely wrapped around the full length of the bead wire. For changing operation from the empty winding reel to the full winding reel it is required to stop operation of the wrapping apparatus. After operation of the wrapping apparatus is stopped, the trailing end portion unwound from the winding reel is required to be joined to the leading end portion of the full winding reel and then to start the operation of the wrapping apparatus. Difficulties are however encountered in that tedious and laborious operation is needed to change the empty winding reel for the full winding reel and to join the trailing and leading end portions of the strips, thereby resulting in low operational efficiency.

It is therefore an object of the present invention to provide a strip supplying apparatus which eliminates tedious and laborious operations to join the trailing and leading end portions of the strips unwound from the winding reels.

It is another object of the present invention to provide a strip supplying apparatus which enhances operational efficiency in a joining operation of the trailing and leading end portions of the strips unwound from the winding reels.

SUMMARY OF THE INVENTION

In accordance with the present invention, there is provided a strip supplying apparatus comprising in combination, a stationary frame structure; a movable frame structure movable with respect to the stationary frame structure along the side wall of the stationary frame structure and having a plurality of winding reels rotatable on the movable frame structure about an axis of rotation substantially in parallel with a direction in which the movable frame structure are moved with respect to the stationary frame structure, the winding reels being spaced in an equal pitch to each other; drive means mounted on the stationary and movable frame structures for driving the movable frame structure to move with respect to the stationary frame structure by the pitch; unwinding means mounted on the stationary frame structure for unwinding a strip unwound from each of the winding reels; joining means mounted on the stationary frame structure for joining the trailing and leading end portions of the strips unwound from two adjacent winding reels; the unwinding and joining means being held in line with one of the winding reels, detecting means for detecting the trailing end portion of the strip unwound from the winding reel to produce a signal to drive the movable frame structure to move with respect to the stationary frame structure by the pitch; and tension adjusting means mounted on the stationary frame structure at the downstream side of the unwinding means for adjusting tension of the strip fed from the unwinding means.

BRIEF DESCRIPTION OF THE DRAWINGS

Features and advantages of a strip supplying apparatus according to the present invention will be understood from the following description taken in conjunction with the accompanying drawings, in which.

DESCRIPTION OF THE EMBODIMENT

Figure 1:
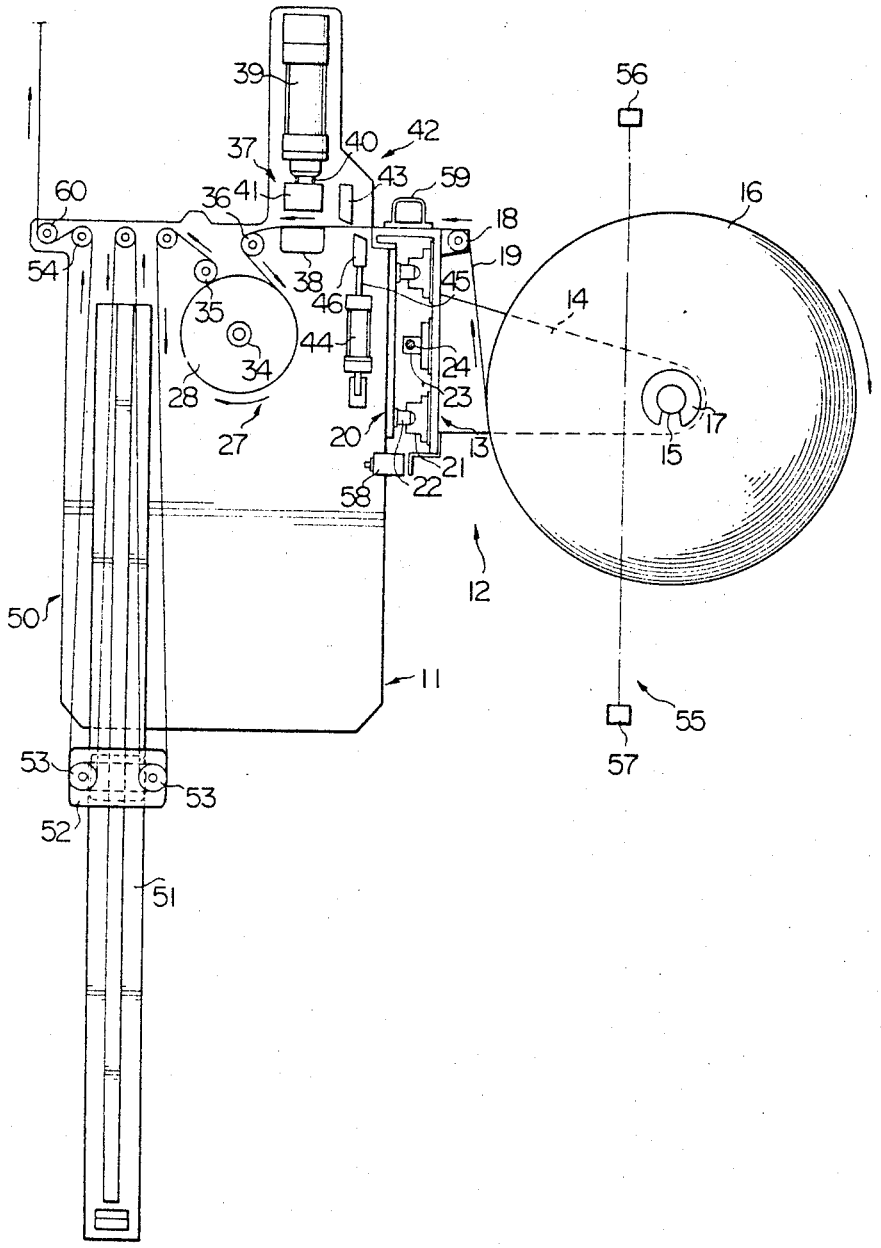
FIG. 1 is a side view of a preferred embodiment of a strip supplying apparatus according to the present invention.

For better understanding of the features and advantages of the present invention description will now be made with reference to FIGS. 1 and 2. The strip supplying apparatus according to the present invention is shown as comprising a stationary frame structure 11 and a movable frame structure 12 which is movable with respect to the stationary frame structure 11. The movable frame structure 12 comprises a base member 13, a bracket arm 14 having a fixed end portion securely connected to the base member 13 and a free end portion, and a supporting shaft 15 securely connected at one end portion to the free end portion of the bracket arm 14 and extending in a direction in which the movable frame structure 12 is moved with respect to the stationary frame structure 11. The supporting shaft 15 has a plurality of winding reels 16 supported on the movable frame structure 12 in such a manner that the winding reels 16 are spaced in an equal pitch from each other by a plurality of spacers 17 on the supporting shaft 15, the winding reels 16 being rotatable about an axis of rotation substantially in parallel with a direction in which the movable frame structure 12 are moved with respect to the stationary frame structure 11. On the upper portion of the base member 13 of the movable frame structure 12 in the vicinity of the side wall of the stationary frame structure 11 are rotatably mounted a plurality of guide rollers 18 which are spaced apart from each other substantially in line with the winding reels 16, respectively for purpose of guiding strips 19 unwound from the winding reels 16. The strip supplying apparatus according to the present invention further comprises drive means 20 mounted on the stationary and movable frame structures 11 and 12 for driving the movable frame structure 12 to move with respect to the stationary frame structure 11 by the pitch. The drive means 20 comprises a pair of guide rails 21 securely mounted on the surface of the base member 13 facing to the side wall of the stationary frame structure 11 and extending in spaced relationship to each other and in parallel with a direction in which the movable frame structure 12 is moved with respect to the stationary frame structure 11, and a pair of guide projections 22 securely mounted on the side wall of the stationary frame structure 11 and extending in spaced relationship to each other and in parallel with a direction in which the movable frame structure 12 is moved with respect to the stationary frame structure 11, the guide projections 22 being in slidable engagement with the guide rails 21, respectively, a rack bracket member 23 securely mounted on the surface of the base member 13 facing to the side wall of the stationary frame structure 11 between the guide rails 21 and extending in spaced and parallel relationship to the guide rails 21, a rack member 24 supported on the rack bracket member 23, and a pinion member 25 securely coupled to an electric motor 26 securely mounted on the stationary frame structure 11 and drivably engaged with the rack member 24. The strip supplying apparatus according to the present invention further comprises unwinding means 27 mounted on the stationary frame structure 11 for unwinding a strip unwound from each of the winding reels 16. The unwinding means 27 comprises a drive roller 28 rotatably mounted on the stationary frame structure 11 and having an axis rotation extending in a direction in which the movable frame structure 12 is moved with respect to the stationary frame structure 11. The drive roller 28 is driven by an electric motor 29 securely mounted on the stationary frame structure 11 through an endless drive belt 30 passed around a drive pulley 31 secured to an output shaft 32 of the electric motor 29 and an driven pulley 33 secured to an input shaft 34 of the drive roller 28. The unwinding means 27 further comprises a friction roller 35 rotatably mounted on the stationary frame structure 11 and having an axis of rotation in parallel with the axis of rotation of the drive roller 28, the friction roller 35 being in frictional contact with the drive roller 28, an idle roller 36 rotatably mounted on the stationary frame structure 11 adjacent to the friction roller 35 and at the upstream side of the drive roller 28 to allow the strip 19 to come in contact with the surface portion of the drive roller 28 and having an axis of rotation in parallel with the axis of rotation of the drive roller 28. The strip supplying apparatus embodying the present invention further comprises joining means 37 mounted on the stationary frame structure 11 for joining the trailing and leading end portions of the strips 19 unwound from two adjacent winding reels 16. The joining means 37 comprises a fixed stamp member 38 securely mounted on the stationary frame structure 11 between the drive means 20 and the unwinding means 27, a power cylinder 39 securely mounted on the stationary frame structure 11 and extending toward the fixed stamp member 38, the power cylinder 39 having a piston rod 40 projectable toward and retractable away from the fixed stamp member 38, and a movable stamp member 41 securely connected to the leading end of the piston rod 40 of the power cylinder 39. The strip supplying apparatus according to the present invention further comprises cutting means 42 comprising a fixed cutting member 43 securely mounted on the stationary frame structure 11 between the joining means 37 and the drive means 20, a power cylinder 44 securely mounted on the stationary frame structure 11 and extending toward the fixed cutting member 43, the power cylinder 44 having a piston rod 45 projectable toward and retractable away from the fixed cutting member 43, and a movable cutting member 46 securely connected to the leading end of the piston rod 45 of the power cylinder 44, the movable cutting member 46 being operative to cut the strip 19 together with the fixed cutting member 43 when the piston rod 45 of the power cylinder 44 is caused to project toward the fixed cutting member 43. The strip supplying apparatus according to the present invention further comprises a strip waiting plate member 47 securely mounted on the stationary frame structure 11 and extending in parallel with a direction in which the movable frame structure 12 is moved with respect to the stationary frame structure 11. The strip waiting plate member 47 has a horizontal upper surface higher than the path of the strip 19 unwound from each of the winding reels 16 and formed with two holes 48 and 49. The hole 48 allows the movable stamp member 41 to move toward the fixed stamp member 38 while the other hole 49 allows the movable cutting member 46 to move toward the fixed cutting member 43. The leading end portions of the strips are placed on the strip waiting plate member 47 to wait strip joining chances of having each of the trailing and leading end portions of the strip 19 on the fixed stamp member 38 of the joining means 37 joined to each other. The strip supplying apparatus according to the present invention further comprises tension adjusting means 50 mounted on the stationary frame structure 11 at the downstream side of the unwinding means 27 for adjusting tension of the strip 19 fed from the unwinding means 27. The tension adjusting means 50 comprises a fixed guide member 51 securely mounted on the stationary frame structure 11 and extending in parallel with a direction in which the piston rod 40 of the power cylinder 39 is caused to project toward and retract away from the fixed stamp member 38, a slide member 52 slidably mounted on the fixed guide member 51, a plurality of movable tension rollers 53 rotatably mounted on the slide member 52 and having axes of rotation spaced apart from each other and in parallel with the axis of the drive roller 28 of the unwinding means 27, and a plurality of fixed tension rollers 54 rotatably mounted on the stationary frame structure 11 and having axes of rotation spaced from each other and in parallel with the axis of the drive roller 28 of the unwinding means 27. The strip supplying apparatus according to the present invention further comprises detecting means 55 for detecting the trailing end portion of the strip unwound from the winding reel 16 to produce a signal to drive the movable frame structure 12 to move with respect to the stationary frame structure 11 by the pitch. The detecting means 55 comprises a photoelectric projector 56 and photoelectric receiver 57 which are disposed immediately and below the path on which the strip 19 travels so that the photoelectric receiver 57 can detect the trailing end portion of the strip 19 unwound from the each of the winding reels 16 since the beam projected from the photoelectric projector 56 is intercepted by the strip 19. The photoelectric receiver 57 is operative to produce a signal to stop rotation of the electric motor 29 so that the drive roller 28 of the unwinding means 27 are stopped. After the drive roller 28 is stopped, the power cylinder 44 is designed to be operated to project the piston rod 45 toward the fixed cutting member 43 so that the movable cutting member 46 cuts the strip 19 together with the fixed cutting member 43. After the cutting operation of the fixed and movable cutting members 43 and 46 of the cutting means 42, the electric motor 26 is designed to be driven to move the movable frame structure 12 by one pitch with respect to the side wall of the stationary frame structure 11 by means of the pinion member 25 and the rack member 24 while being guided by the guide rails 21 and the guide projections 22. A limit switch 58 is attached to the side wall of the stationary frame structure 11 facing to the base member 13 of the movable frame structure 12 to produce two signals one of which is to stop the electric motor 26 and the other of which is to operate the power cylinder 39 of the joining means 37. A slit forming member 59 is securely mounted on the movable frame structure 12 to form together with the upper surface of the base member 13 of the movable frame structure 12 a slit which is adapted to allow the strip 19 unwound from each of the winding reels 16 to pass therethrough. In the vicinity of and at the downstream side of the tension adjusting means 50 is positioned a stationary idle roller 60 which is to change the direction of the path on which the strip 19 travels.

Description will now be made about operation of the embodiment of the strip supplying apparatus according to the present invention.

Figure 2:
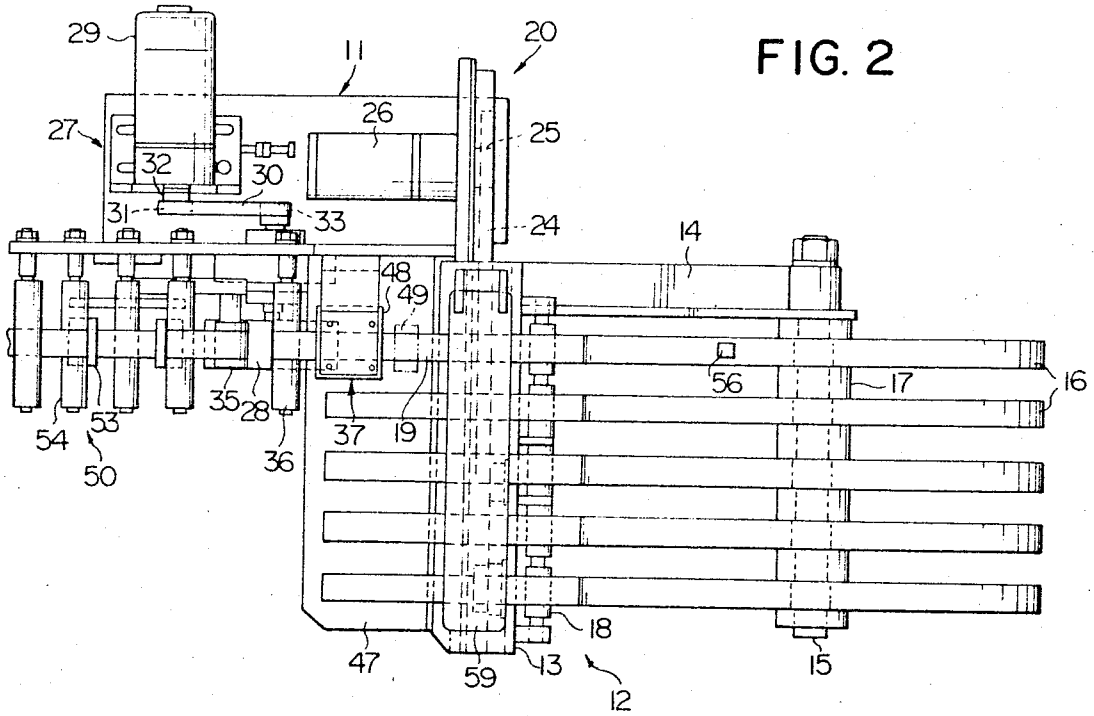
FIG. 2 is a plan view of the embodiment shown in FIG. 1.

At the initial stage of operation of the apparatus, a plurality of full winding reels 16, for example five full winding reels in this embodiment of the apparatus as shown in FIGS. 1 and 2 of the drawings are supported on the supporting shaft 15 with a first full winding reel 16 most adjacent to the bracket arm 14 being held in line with the cutting means 42, the joining means 37, the unwinding means 27 and the tension adjusting means 50. Under these conditions, the leading end portion of the strip 19 unwound from the winding reel 16 is passed on and around the guide roller 18, the idle roller 36, drive roller 28, the friction roller 35, the fixed tension rollers 54, the movable tension rollers 53, and the stationary idle roller 60, while being passed through the slit formed by the upper surface of the base member 13 of the movable frame structure 12 and the slit forming member 59 and then between the fixed and movable cutting members 43 and 46 of the cutting means 42 and then between the fixed and movable stamp members 38 and 41 of the joining means 37. The leading end portion of the strip 19 is connected to a suitable winding apparatus provided in the following process. The leading end portions of the strips 19 are then unwound from the remaining winding reels 16, for example second to five winding reels and placed on the strip waiting plate member 47 to wait strip joining chances of having each of the trailing and leading end portions of the strip 19 on the fixed stamp member 38 of the joining means 37 joined to each other. The electric motor 29 of the unwinding means 27 is started to rotate simultaneously with the rotation of the electric motor of the winding apparatus in the following process so that the drive roller 28 is caused to rotate to unwind the strip 19 from the first winding reel 16 and to supply the strip 19 to the winding apparatus in the following process. At this time, the strip 19 is adjusted in tension by the fixed and movable tension rollers 54 and 53 of the tension adjusting means 50 depending upon the positions of the movable tension rollers 53 with respect to the fixed tension rollers 54. When the strip 19 is finished to be unwound from the first winding reel 16, the photoelectric receiver 57 receives a beam from the photoelectric projector 56 and produces a signal to stop rotation of the electric motor 29 of the unwinding means 27 so that the drive roller 28 is stopped for rotation. After the drive roller 28 is stopped for rotation, the power cylinder 44 is operated to project the piston rod 45 toward the fixed cutting member 43 so that the movable cutting member 46 partially cuts the trailing end portion of the strip 19 together with the fixed cutting member 43. After the cutting operation of the fixed and movable cutting members 43 and 46 of the cutting means 42, the electric motor 26 receives a signal from a limit switch (not shown) in the cutting means 42 and is driven to move the movable frame structure 12 by one pitch with respect to the side wall of the stationary frame structure 11 by means of the pinion member 25 and the rack member 24 while being guided by the guide rails 21 and the guide projections 22. When the movable frame structure 12 is thus moved with respect to the stationary frame structure 11 by one pitch, the limit switch 58 produces two signals one of which is to stop the electric motor 26 and the other of which is to operate the power cylinder 39 of the joining means 37. At this time, the second full winding reel 16 adjacent to the first winding reel 16 is held in line with the cutting means 42, the joining means 37, the unwinding means 27 and the tension adjusting means 50, while the first empty winding reel 16 is dislocated from being held in line with the cutting means 42, the joining means 37, the unwinding means 27 and the tension adjusting means 50. The leading end portion of the strip 19 unwound from the second winding reel 16 and placed on the strip waiting plate member 47 is also moved to and overlapped onto the trailing end portion of the strip 19 unwound from the first winding reel 16 on the fixed stamp member 38 of the joining means 37. The above trailing and leading end portions of the strip 19 is easily overlapped to each other by the reason that the strip waiting plate member 47 has a horizontal upper surface higher than the path of the strip 19 unwound from each of the winding reels 16. The leading end portion of the strip 19 unwound from the second winding reel 16 and placed on the strip waiting plate member 47 is then joined to the trailing end portion of the strip 19 unwound from the first winding reel 16 on the fixed stamp member 38 when the power cylinder 39 is caused to project toward the fixed stamp member 38 to bring the movable stamp member 41 into contact with the fixed stamp member 38. The above trailing and leading end portions of the strip 19 are easily joined to each other only with pressure caused by the power cylinder 39 and without any adhesive materials since the strips 19 has adhesive forces to the degree that strips 19 can not be adhered to any parts, members, and the like used in the strip supplying apparatus according to the present invention. The strip 19 placed on the strip waiting plate member 47 is therefore moved easily relatively with respect to the upper surface of the strip waiting plate member 47. After the above trailing and leading end portions of the strip 19 are joined to each other by the fixed and movable stamp members 38 and 41, the electric motor 29 receives a signal from a limit switch (not shown) in the joining means 37 and is driven to rotate the drive roller 28 of the unwinding means 27.

While there has been described about one cycle of the operation of the strip supplying apparatus according to the present invention, such cycles will be repeated for purpose of supplying strips to the apparatus in the following process.

As has been described in the above, the strip can be fed to the wrapping apparatus in the following process without stopping the strip supplying apparatus in a time period between a time when the electric motor is stopped and a time when the trailing and leading end portions of the strips are joined to each other since the positions of the movable tension rollers 53 is moved on the fixed guide member 51 with respect to the fixed tension rollers 54 to continue supplying the strip 19 to the strip wrapping apparatus. The number of the fixed and movable tension rollers 54 and 53 are decided upon the time period between the time when the electric motor is stopped and the time when the trailing and leading end portions of the strips are joined to each other.

What is claimed is:

1. A strip supplying apparatus comprising in combination, a stationary frame structure;

a movable frame structure movable with respect to said stationary frame structure along the side wall of said stationary frame structure and having a plurality of winding reels rotatable on said movable frame structure about an axis of rotation substantially in parallel with a direction in which said movable frame structure are moved with respect to said stationary frame structure, said winding reels being spaced in an equal pitch to each other;

drive means mounted on said stationary and movable frame structures for driving said movable frame structure to move with respect to said stationary frame structure by said pitch;

unwinding means mounted on said stationary frame structure for unwinding a strip unwound from each of said winding reels;

joining means mounted on said stationary frame structure for joining the trailing and leading end portions of said strips unwound from two adjacent winding reels; said unwinding and joining means being held in line with one of said winding reels;

detecting means for detecting the trailing end portion of said strip unwound from said winding reel to produce a signal to drive said movable frame structure to move with respect to said stationary frame structure by said pitch; and tension adjusting means mounted on said stationary frame structure at the downstream side of said unwinding means for adjusting tension of said strip fed from said unwinding means.

2. A strip supplying apparatus as set forth in claim 1, in which said movable frame structure comprises a base member having portions in slidable engagement with said side wall of said stationary frame structure, a bracket arm having a fixed end portion securely connected to said base member and a free end portion, and a supporting shaft securely connected at one end portion to said free end portion of said bracket arm and extending in a direction in which said movable frame structure is moved with respect to said stationary frame structure, the supporting shaft having said winding reels supported thereon.

3. A strip supplying apparatus as set forth in claim 1, in which said movable frame structure comprises a base member, a bracket arm having a fixed end portion securely connected to said base member and a free end portion, and a supporting shaft securely connected at one end portion to said free end portion of said bracket arm and extending in a direction in which said movable frame structure is moved with respect to said stationary frame structure, the supporting shaft having said winding reels supported thereon, and in which said drive means comprises a pair of guide rails securely mounted on the surface of said base member facing to the side wall of said stationary frame structure and extending in spaced relationship to each other and in parallel with a direction in which said movable frame structure is moved with respect to said stationary frame structure, and a pair of guide projections securely mounted on the side wall of said stationary frame structure and extending in spaced relationship to each other and in parallel with a direction in which said movable frame structure is moved with respect to said stationary frame structure, the guide projection being in slidable engagement with said guide rails, respectively, a rack bracket member securely mounted on the surface of said base member facing to the side wall of said stationary frame structure between said guide rails and extending in spaced parallel relationship to said guide rails, a rack member supported on said rack bracket member, and a pinion member securely coupled to an electric motor securely mounted on said stationary frame structure and drivably engaged with said rack member.

4. A strip supplying apparatus as set forth in claim 3, in which said unwinding means comprises a drive roller rotatably mounted on said stationary frame structure and having an axis of rotation extending in a direction in which said movable frame structure is moved with respect to said stationary frame structure, the drive roller being driven by an electric motor securely mounted on said stationary frame structure, a friction roller rotatably mounted on said stationary frame structure and having an axis of rotation in parallel with the axis of rotation of the drive roller, the friction roller being in frictional contact with said drive roller, and an idle roller rotatably mounted on said stationary frame structure adjacent to said friction roller and at the upstream side of said drive roller to allow said strip to come in contact with the surface portion of said drive roller and having an axis of rotation in parallel with the axis of rotation of said drive roller.

5. A strip supplying apparatus as set forth in claim 4, in which said joining means comprises a fixed stamp member securely mounted on said stationary frame structure between said drive means and said unwinding means, a power cylinder securely mounted on said stationary frame structure and extending toward said fixed stamp member, the power cylinder having a piston rod projectable toward and retractable away from said fixed stamp member, and a movable stamp member securely connected to the leading end of said piston rod of said power cylinder.

6. A strip supplying apparatus as set forth in claim 6, which further comprises cutting means comprising a fixed cutting member securely mounted on said stationary frame structure between said joining means and said drive means, a power cylinder securely mounted on said stationary frame structure and extending toward said fixed cutting member, the power cylinder having a piston rod projectable toward and retractable away from said fixed cutting member, and a movable cutting member securely connected to the leading end of said piston rod of said power cylinder, the movable cutting member being operative to cut said strip together with said fixed cutting member when said piston rod of said power cylinder projects toward said fixed cutting member.

7. A strip supplying apparatus as set forth in claim 6, which further comprises a strip waiting plate member securely mounted on said stationary frame structure and extending in parallel with a direction in which said movable frame structure is moved with respect to said stationary frame structure, the strip waiting plate member having a horizontal upper surface higher than the path of said strip unwound from each of said winding reels and formed with two holes, one of the holes allowing said movable stamp member to move toward said fixed stamp member and the other hole allowing said movable cutting member to move toward said fixed cutting member so that the leading end portions of said strips are placed on said strip waiting plate member to wait strip joining chances of having each of the trailing and leading end portions of said strip on said fixed stamp member of said joining means joined to each other.

8. A strip supplying apparatus as set forth in claim 7, in which said tension adjusting means comprises a fixed guide member securely mounted on said stationary frame structure and extending in parallel with a direction in which said piston rod of said power cylinder is caused to project toward and retract away from said fixed stamp member, a slide member slidably mounted on said fixed guide member, a plurality of movable tension rollers rotatably mounted on said slide member and having axes of rotation spaced apart from each other and in parallel with the axis of said drive roller of said unwinding means, and a plurality of fixed tension rollers rotatably mounted on said stationary frame structure and having axes of rotation spaced from each other and in parallel with the axis of said drive roller of said unwinding means.

* * * * *